US007009098B2

(12) United States Patent
Carter

(10) Patent No.: US 7,009,098 B2
(45) Date of Patent: Mar. 7, 2006

(54) WATER ACTIVATED CHIMING DEVICE

(75) Inventor: Raymond Carter, Cornwall, NY (US)

(73) Assignee: Woodstock Percussion, Inc., Shokan, NY (US)

( * ) Notice: Subject to any disclaimer, the term of this patent is extended or adjusted under 35 U.S.C. 154(b) by 0 days.

(21) Appl. No.: 10/809,714

(22) Filed: Mar. 26, 2004

(65) Prior Publication Data

US 2005/0211060 A1 Sep. 29, 2005

(51) Int. Cl.
*G10D 13/08* (2006.01)

(52) U.S. Cl. ..... 84/410

(58) Field of Classification Search ..... 84/402–410, 84/103

See application file for complete search history.

(56) References Cited

U.S. PATENT DOCUMENTS 1,912,562 A 6/1933 Zynda
4,627,326 A 12/1986 McFarland
4,949,385 A 8/1990 Murphy
5,072,208 A * 12/1991 Christensen ..... 340/392.4
D370,183 S 5/1996 Christensen
6,095,889 A 8/2000 Demarinis
6,166,310 A 12/2000 Carter
6,417,763 B1 7/2002 Petruzzi
6,768,416 B1 * 7/2004 Petruzzi ..... 340/392.1

* cited by examiner

*Primary Examiner*—Kimberly Lockett
(74) *Attorney, Agent, or Firm*—Patrick J. Glynn

(57) ABSTRACT

Upward flowing water through a riser from a reservoir excites a freely suspended striker displacing it from its gravitational resting position to make chaotic contact with encircling resonating elements attached to a mounting plate in order to produce tones of random sequence and degree. The upward water flow is generated by a pump submerged in the water reservoir that is replenished by the gravity flow of water returning through an aperture in the mounting plate. The striker is freely suspended from a frame assembly including a means to raise or lower the striker in relation to the upward water flow, so that raising or lowering the striker decreases or increases respectively the production of tones or random sequence and degree. The preferred striker is spherical and the preferred resonating elements are chimes included in a housing forming a resonating chamber.

8 Claims, 4 Drawing Sheets

WATER ACTIVATED CHIMING DEVICE

BACKGROUND OF THE INVENTION

Wind chiming devices are traditionally used outdoors where naturally occurring wind activates a clapper that impacts with a configuration of resonating elements, including suspended tubular wind chimes. Such devices are also used indoors where artificial means is employed to create resonating tones that in many cases are soporific for individuals inside a dwelling or building. For example, U.S. Pat. No. 6,417,763 uses gravity flow to activate an assortment of bell-like resonating elements. Water flows down a series of tiers exciting the resonating elements or bells at random. Another embodiment uses a magnetic field causing chime elements to impact with a center post. In either case the chimes are impacting with each other. This patent requires the assembly of elements that could prove costly to the average consumer. U.S. Pat. No. 4,949,385 uses a configuration of horizontally disposed chimes mounted on a bracket attached to the outside of a building. The chimes capture the impact of falling rain that motivates the chimes producing pleasing tones outdoors. This device is subject to weathering over time and is optimally heard through an open window allowing the entry of rain into the building. U.S. Pat. No. 4,627,326 discloses a musical faucet. Water flowing under pressure through a conduit activates a water wheel in the conduit causing a rotating drum to strike a musical comb containing a selected number of tuned tines. This device is complicated in design and would be expensive to make and assemble. U.S. Pat. No. 6,441,248 uses an upward air current against a sail that motivates a pendulum having an overhanging striker that is used to impact a configuration of chimes to produce random tones. The upward current of air is produced by a motor driven fan creating a noise factor masking the tones produced by the chimes.

There is no suggestion or disclosure in these patents of employing one and the same excitable means and striker, nor the adjustable suspension means discussed below.

SUMMARY OF THE INVENTION

According to the present invention, upward flowing water is produced by a submerged electric pump and directed upward where it is delivered to a freely suspended striker, preferably spherical in shape, that is excited by the upward flowing water. The chaotic displacement of the striker from its gravitational resting position by the force of the water causes the striker to impact with at least one resonating element. It is preferred however to have a configuration of solid tuned chimes encircling the suspended striker. This produces tones of random sequence and degree that emulates the effect of wind outdoors. The height of the striker can be adjusted manually in order to raise or lower the level of the striker in contact with the upward flow of water. Raising the level of the striker will decrease production of tones of random sequence and degree. Lowering the striker will increase such production of tones. A frame assembly is provided to suspend the striker over the upward flowing water and it is preferred to have the chimes included in a resonating chamber formed by a housing made of clear plastic.

It is therefore an object of the present invention to provide a pleasing concert of sound produced by bubbling water and resonating tones of random sequence and degree from tuned chimes.

It is another object of the present invention to dampen the sound generated by the electric motor of the pumping apparatus by submerging the pump in a reservoir that serves as the source of water for exciting the striker.

It is another object of the present invention to provide a pleasing chiming device indoors that is protected from exposure to outside elements.

It is yet another object of the invention to provide a chiming mechanism that embodies simplicity and is cost effective to produce.

It is another object of the invention to produce the pleasing visual effects of fountain-like water acting against an excited striker impacting with a configuration of tunes chimes.

DETAILED DESCRIPTION OF THE PREFERRED EMBODIMENT

Figure 1:
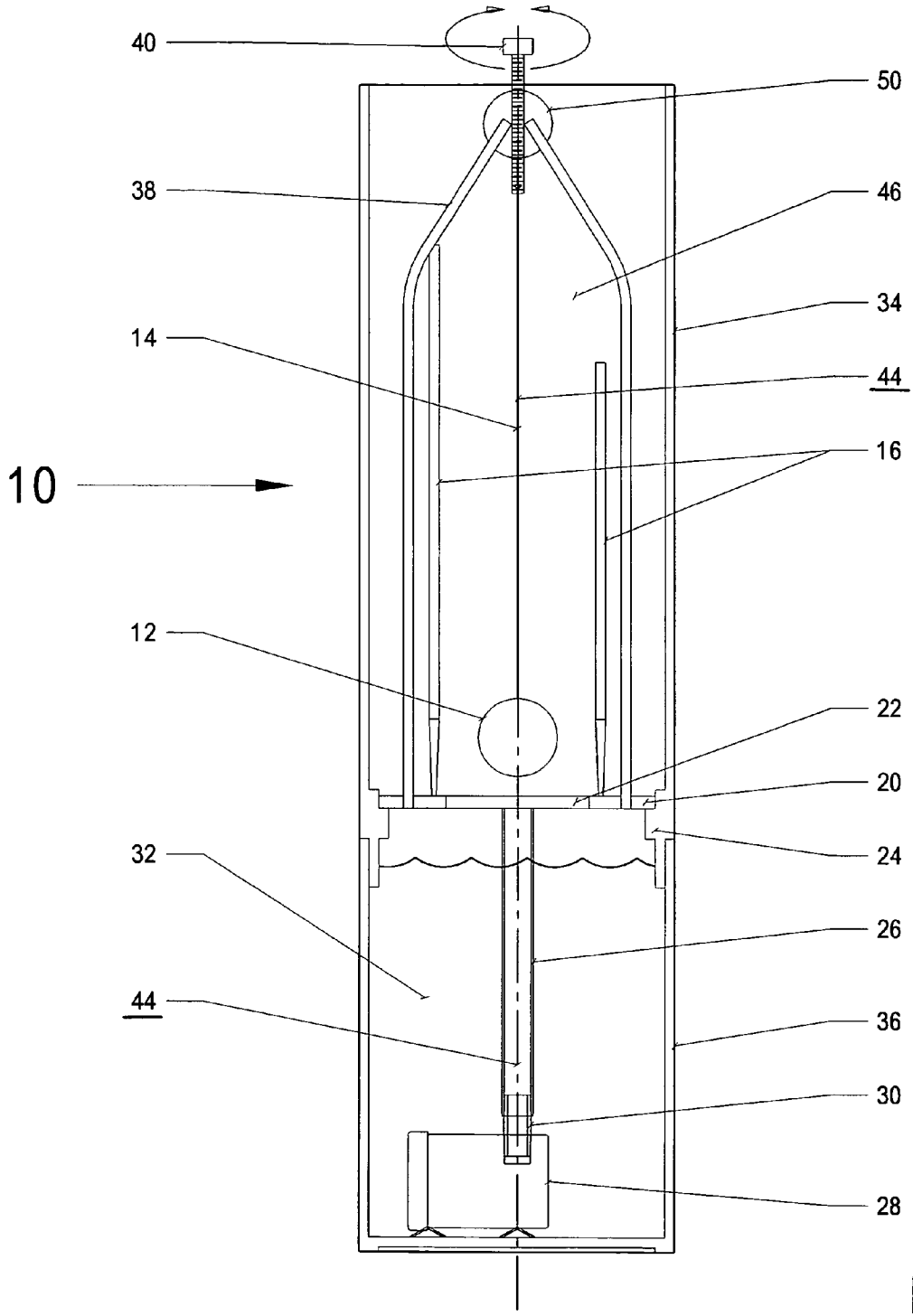
FIG. 1 is a side view of the preferred chiming device of the present invention showing the preferred spherical striker in the gravitational resting position.
Figure 2:
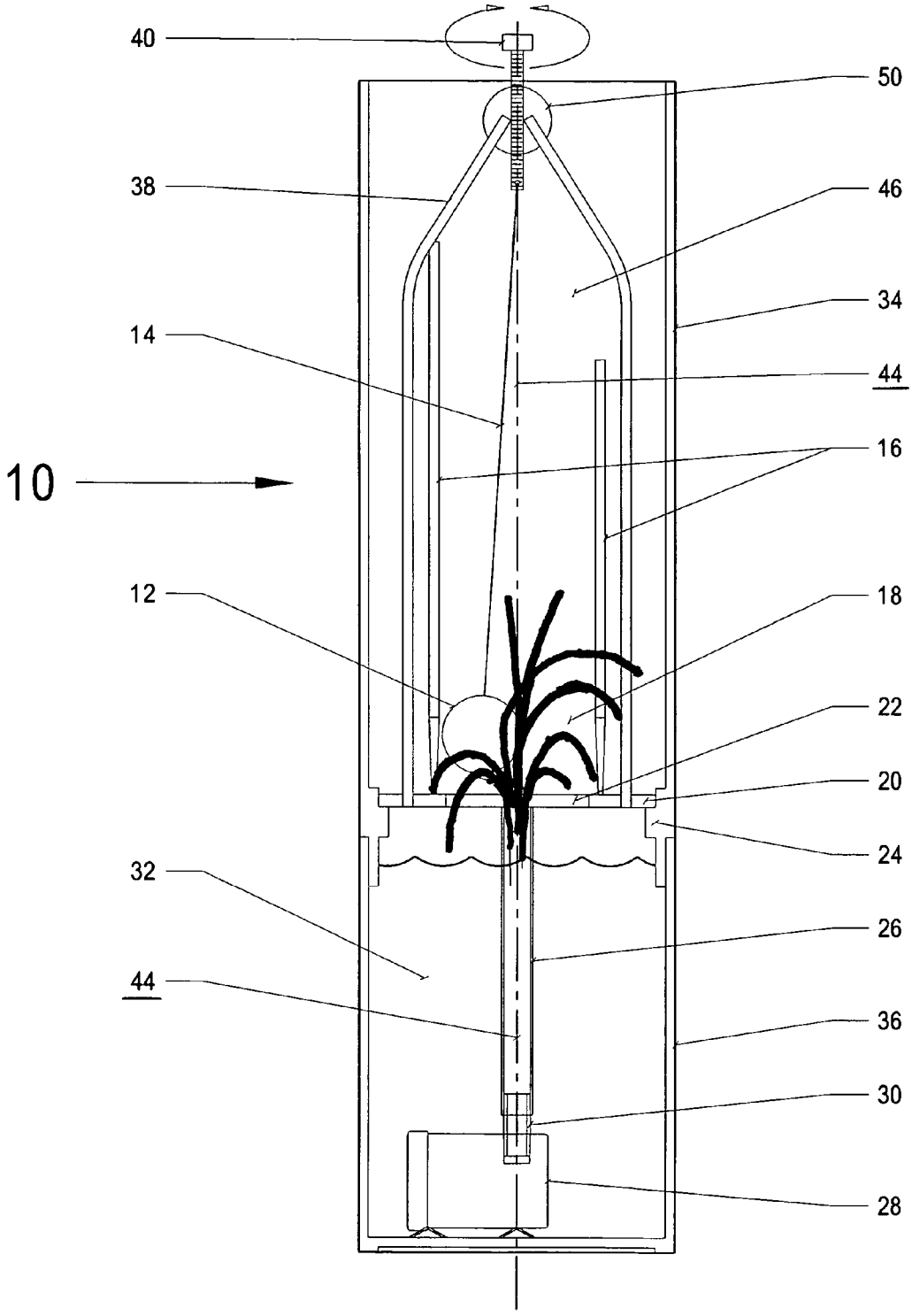
FIG. 2 is a side view of the chiming device of the present invention showing the upward flowing water exciting the preferred striker impacting a nearby tuned chime.
Figure 4:
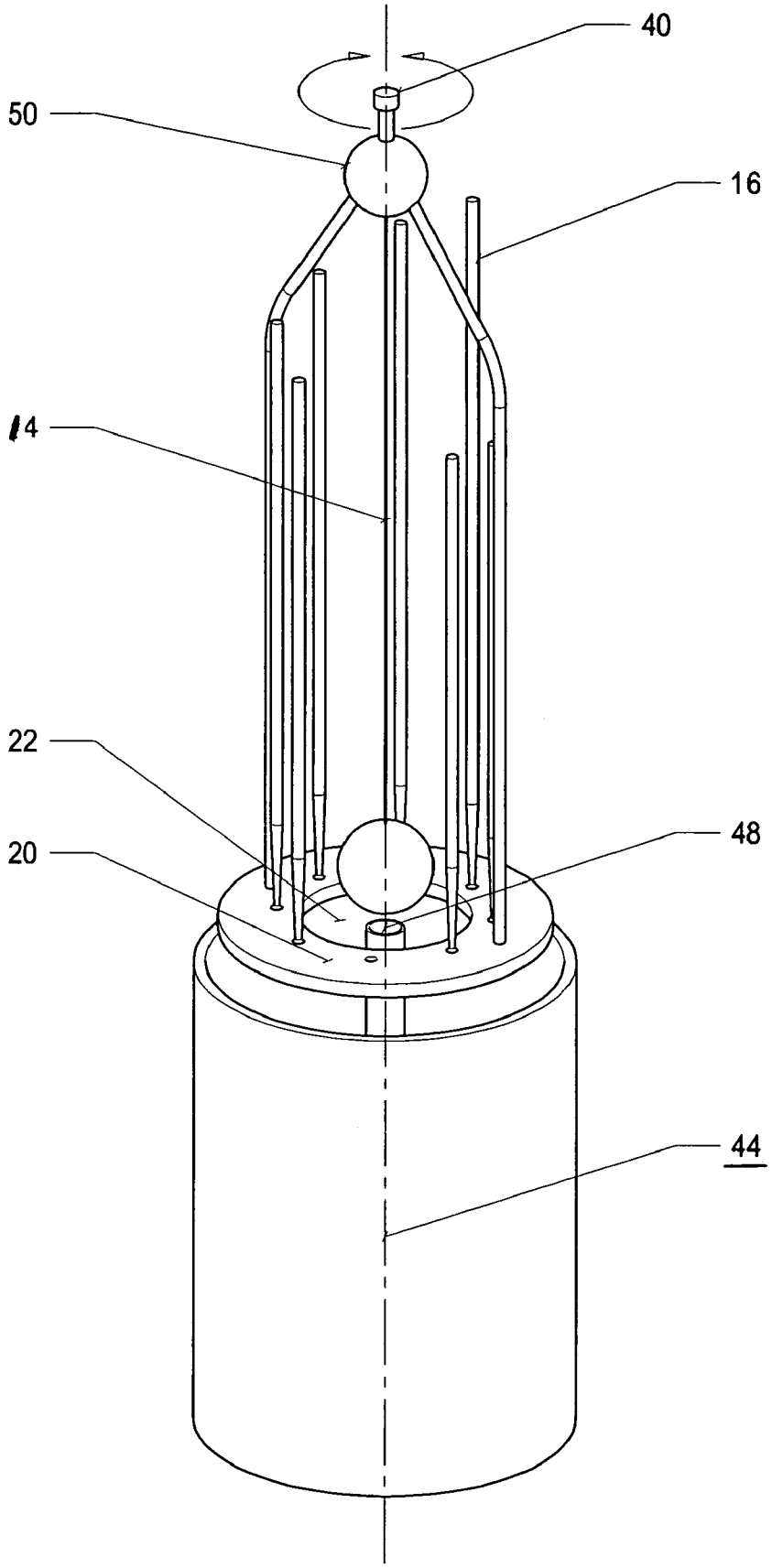
FIG. 4 is an overhead perspective view of the chiming device without the housing element, showing the circular aperture between the reservoir and the upper body and the circular placement of the tuned chimes in the mounting plate of the present invention.

FIG. 1 shows the preferred chiming device 10 of the invention including the spherical striker 12. Water from reservoir 32 is delivered to striker 12 by the electrical pump 28 through riser 26, comprising a tube having a preferred circular opening 48 at the top end shown in FIG. 4. As shown in FIG. 2, upward flowing water 18 is discharged and delivered to striker 12. Coupling 30 connects riser 26 to pump 28. The lower end of riser 26 and pump 28 are submerged in the reservoir 32. The internal sound of pump 28 is dampened by reservoir 32 so that the sound of the pump 28 is masked by water absorption. The reservoir 32 is replenished by water flowing back into the reservoir 32 through aperture 22 of the mounting plate 20 shown in FIG. 4. The water that is discharged at the top end of the riser 26 resembles the upward flowing water from a drinking fountain. The mounting plate 20 divides the chiming device 10 into the upper body of the chiming device 10, including the housing 34, and the reservoir container 36. The annular mounting plate support 24 secures the mounting plate 20 in proper position at the top the reservoir container 36. The spherical striker 12 is freely suspended by suspension means 14 comprising any suitable flexible material, such as, a cord or a metallic chain for raising and lowering the striker 12 relative to the upward water flow by adjustment means, preferably the threaded bolt 40 displaced in ball 50. The striker 12 is raised or lowered by unscrewing or screwing, respectively, the bolt 40 while the suspension means 14 and ball 50 remain constant. Frame assembly 38, is mounted to plate 20 as shown in FIG. 1 to insure that suspension means 14, striker 12 and riser 26 lie along vertical axis 44 for proper operation of the chiming device 10 according to the invention.

The preferable resonating means comprises the plurality of solid rod chimes 16 that are mounted at their lower end to mounting plate 20 in a circular configuration. Each chime 16 is sized to a different length for tuning purposes according to a predetermined scale. The chimes 16 are preferably included in a resonating chamber 46 formed by housing 34. This serves to amplify the tones produced by the chimes 16. Housing 34 is open at the top so that the resonating tones are spread throughout the listening area.

FIG. 1 shows the striker 12 in the gravitational resting position where the striker and the suspension means 14 lie substantially along vertical axis 44 and directly over riser 26. In operation, as shown in FIG. 2, the chaotic upward flow of water is delivered to striker 12 exciting the striker 12 so that it is chaotically displaced from its gravitational resting position for impacting with the adjacent chimes 16. This translates into the production of tones of random sequence and degree. The striker 12 is preferably spherical because a round surface is most capable of responding to the fluid dynamics of the upward flowing water. The striker 12, however, can have a faceted surface and can assume any shape that allows for random contact with the chimes 16. The resonating elements can take the form of bells or any shaped objects for ornamentation that are capable of producing pleasing tones for visual, as well as listening pleasure. Moreover, designs can be inscribed or placed on the inside or outside surface of housing 34 for decoration.

The striker 12 and housing 34 can be made of any suitable material, such as, glass or clear acrylic plastic and the size and weight of the striker 12 can be selected for optimum performance. Housing 34 is optional depending upon the space requirements and configuration of alternative resonating elements.

Figure 3:
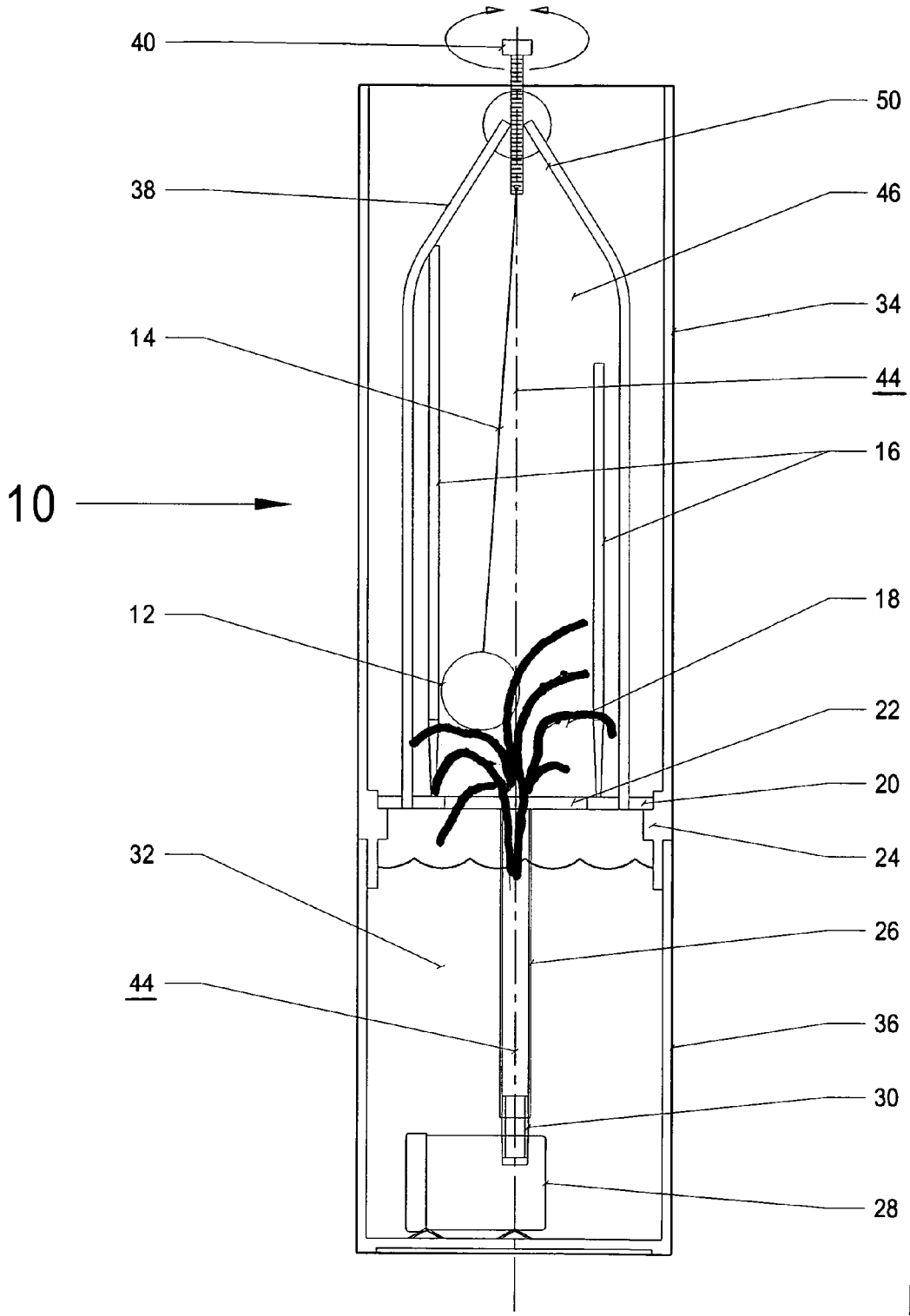
FIG. 3 is a side view of the chiming device of the present invention showing the preferred striker in an elevated striking position.

A unique feature of the invention is the adjustable means 40 whereby the striker 12 can be raised or lowered relative to the upward water flow 18. Unscrewing or turning the threaded bolt 40 in counter-clockwise motion will cause the bottom of the bolt 40 to elevate. This elevation will be transmitted to suspension means 14 raising the striker 12 relative to the upward flow of water 18, while the suspension means 14 and ball 50 remain constant. By turning the bolt clockwise or screwing the threaded bolt into the ball 50, the opposite effect is produced. The difference is illustrated in FIGS. 2 and 3 and changes the degree of excitation of the striker 12 without the need for adjusting the pumping speed by external controls that regulate the electrical current delivered to pump 28. In other words, the pumping speed controlling the upward force of the water can remain constant, while the frequency and degree of random chiming can be changed by turning the bolt 40. This modulation occurs because the upward water flow 18 levels off at its apex when overcome by gravity which causes the water to flow down upon itself and back into the reservoir 32. Therefore, elevating the excited striker 12 toward the apex of the upward flow of water 18 reduces the force of water in contact with the surface of striker 12. (FIG. 3) As a result, excitation of the striker is diminished and this accordingly lowers the frequency and degree of random impact with chimes 16. As mentioned above, the opposite effect is obtained by lowering the striker 12 against the upward water flow 18 (FIG. 2) without necessitating an increase in power to pump 28 or making any adjustments other than to bolt 40.

Excitation occurs when the upward flow 18 chaotically displaces the freely suspended striker 12 from its gravitational resting position along axis 44 as shown in FIG. 1, causing it to impact with the adjacent chimes 16. As mentioned, the spherical striker 12 is preferred because the upward water flows smoothly over the rounded surface of the sphere and produces efficient excitation.

The foregoing discussion discloses and describes merely exemplary methods and embodiments of the present invention. One skilled in the art will readily recognize from such discussion that various changes, modifications and variations may be made therein without departing from the spirit and scope of the invention. Accordingly, disclosure of the present invention is intended to be illustrative, but not imitating, of the scope of the invention, which is set forth in the following claims and their legal equivalents.

I claim:

1. A water activated chiming device to produce tones of random sequence and degree, comprising:

at least one resonating means for producing a tone or sound when impacted, a free hanging striker suspended along a vertical axis adjacent to said resonating means for striking said resonating means, a means for delivering an upward flow of water having an apex located substantially on said vertical axis to said striking means for exciting said striking means resulting in chaotic impacts with said resonating means to produce tones of random sequence and degree, a means for adjustable suspension of said striking means along said vertical axis whereby elevating said striking means relative to said apex decreases the production of tones of random sequence and degree and lowering said striking means relative to said apex increases the production of tones of random sequence and degree, and a means to support and align the elements.

2. The water activated chiming device of claim 1, wherein said striking means is spherical.

3. The water activated chiming device of claim 1, wherein said means for delivering upward water flow includes a conduit positioned along said vertical axis having a horizontal upper end and a pumping apparatus coupled to the lower end of said conduit for producing upward water flow through said conduit to said striker.

4. The water activated chiming device of claim 1, including a water reservoir submerging said lower end of said conduit and said pumping apparatus.

5. The water activated chiming device of claim 3, wherein said conduit is a vertical pipe having a circular opening at said upper end.

6. The water activated chiming device of claim 1, wherein said resonating means includes a configuration of tuned chimes encircling said striker.

7. The water activated chiming device of claim 6 wherein said configuration of chimes are included in a resonating chamber formed by a housing.

8. The water activated chiming device of claim 1, wherein a body or framework supports and unifies the elements in a proper working relationship.

* * * * *